US006811539B1

(12) United States Patent
Nguyen

(10) Patent No.: US 6,811,539 B1
(45) Date of Patent: Nov. 2, 2004

(54) HEATED VIBRATING FOOT MASSAGING DEVICE

(76) Inventor: Duc T. Nguyen, 838 Halliday Rd., St. Cloud, MN (US) 56301

( * ) Notice: Subject to any disclaimer, the term of this patent is extended or adjusted under 35 U.S.C. 154(b) by 341 days.

(21) Appl. No.: 09/960,061

(22) Filed: Sep. 21, 2001

(51) Int. Cl.[7] ..... A61H 1/00

(52) U.S. Cl. ..... 601/31; 601/27; 601/28; 601/89; 601/46

(58) Field of Search ..... 601/15, 18–22, 601/27–28, 118, 131, 89, 46

(56) References Cited

U.S. PATENT DOCUMENTS

| | | | | | |
|---|---|---|---|---|---|
| 2,037,495 | A | * | 4/1936 | Brogan | 601/118 |
| D101,862 | S | * | 11/1936 | Fehn et al. | D24/212 |
| 2,101,503 | A | * | 12/1937 | Lang | 601/118 |
| 2,121,250 | A | * | 6/1938 | Koschwitz | 601/118 |
| 2,582,686 | A | * | 1/1952 | Fabio | 601/118 |
| 2,583,686 | A | | 1/1952 | Fabio | |
| 3,887,179 | A | * | 6/1975 | Klepper et al. | 472/127 |
| D243,557 | S | | 3/1977 | Kientz | |
| 4,142,519 | A | * | 3/1979 | Ferguson | 601/118 |
| 4,380,231 | A | * | 4/1983 | Rocha et al. | 601/118 |
| 5,005,560 | A | * | 4/1991 | Quam et al. | 601/113 |
| 5,131,383 | A | | 7/1992 | Juarez | |
| 5,251,620 | A | * | 10/1993 | Boucher et al. | 601/122 |
| 5,558,625 | A | | 9/1996 | McKay | |
| 5,830,161 | A | * | 11/1998 | Cosmano | 601/121 |
| 6,385,795 | B1 | * | 5/2002 | Ferber et al. | 4/622 |

* cited by examiner

*Primary Examiner*—Justine Romang Yu

(57) ABSTRACT

A heated vibrating foot massaging device for reducing tension in the feet of a user. The heated vibrating foot massaging device includes a base member having a plurality of wall members for pivotally supporting an elongate semi-circularly shaped massage unit. The massage unit incorporates both a vibrator assembly and a heater unit coupled to heating elements thereby providing both oscillatory and thermal comfort. A plurality of pressure points are positioned on the exterior surface for therapeudic action.

9 Claims, 4 Drawing Sheets

HEATED VIBRATING FOOT MASSAGING DEVICE

BACKGROUND OF THE INVENTION

1. Field of the Invention

The present invention relates to foot massagers and more particularly pertains to a new heated vibrating foot massaging device for reducing tension in the feet of a user.

2. Description of the Prior Art

The use of foot massagers is known in the prior art. More specifically, foot massagers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,830,161; 5,131,383; 2,583,686; 5,251,620; 5,558,625; and Des. 243,557.

While these devices fulfill their respective, particular objectives and requirements, the aforementioned patents do not disclose a new heated vibrating foot massaging device. The inventive device includes a base member having a plurality of wall members for pivotally supporting an elongate semi-circularly shaped massage unit. The massage unit incorporates both a vibrator assembly and a heater unit coupled to heating elements thereby providing both oscillatory and thermal comfort. Pluralities of pressure points are positioned on the exterior surface for therapeutic action.

In these respects, the heated vibrating foot massaging device according to the present invention substantially departs from the conventional concepts and designs of the prior art, and in so doing provides an apparatus primarily developed for the purpose of reducing tension in the feet of a user.

SUMMARY OF THE INVENTION

In view of the foregoing disadvantages inherent in the known types of foot massagers now present in the prior art, the present invention provides a new heated vibrating foot massaging device construction wherein the same can be utilized for reducing tension in the feet of a user.

The general purpose of the present invention, which will be described subsequently in greater detail, is to provide a new heated vibrating foot massaging device apparatus and method which has many of the advantages of the foot massagers mentioned heretofore and many novel features that result in a new heated vibrating foot massaging device which is not anticipated, rendered obvious, suggested, or even implied by any of the prior art foot massagers, either alone or in any combination thereof.

To attain this, the present invention generally comprises a base member having a plurality of wall members for pivotally supporting an elongate semi-circularly shaped massage unit. The massage unit incorporates both a vibrator assembly and a heater unit coupled to heating elements thereby providing both oscillatory and thermal comfort. Pluralities of pressure points are positioned on the exterior surface for therapeutic action.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new heated vibrating foot massaging device apparatus and method which has many of the advantages of the foot massagers mentioned heretofore and many novel features that result in a new heated vibrating foot massaging device which is not anticipated, rendered obvious, suggested, or even implied by any of the prior art foot massagers, either alone or in any combination thereof.

It is another object of the present invention to provide a new heated vibrating foot massaging device that may be easily and efficiently manufactured and marketed.

It is a further object of the present invention to provide a new heated vibrating foot massaging device that is of a durable and reliable construction.

An even further object of the present invention is to provide a new heated vibrating foot massaging device which is susceptible of a low cost of manufacture with regard to both materials and labor, and which accordingly is then susceptible of low prices of sale to the consuming public, thereby making such heated vibrating foot massaging device economically available to the buying public.

Still yet another object of the present invention is to provide a new heated vibrating foot massaging device which provides in the apparatuses and methods of the prior art some of the advantages thereof, while simultaneously overcoming some of the disadvantages normally associated therewith.

Still another object of the present invention is to provide a new heated vibrating foot massaging device for reducing tension in the feet of a user.

Yet another object of the present invention is to provide a new heated vibrating foot massaging device which includes a base member having a plurality of wall members for pivotally supporting an elongate semi-circularly shaped massage unit. The massage unit incorporates both a vibrator assembly and a heater unit coupled to heating elements thereby providing both oscillatory and thermal comfort. Pluralities of pressure points are positioned on the exterior surface for therapeutic action.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
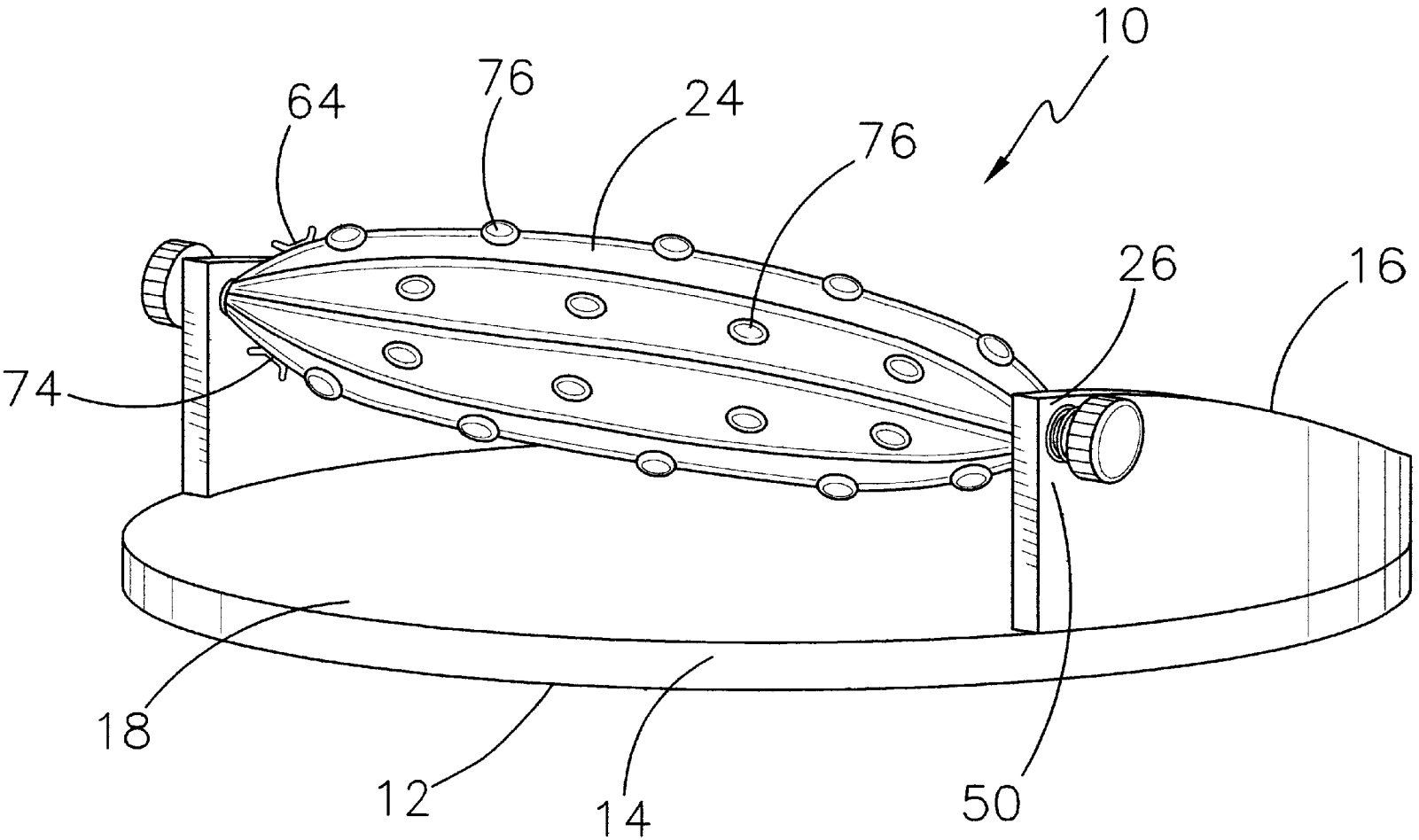
FIG. 1 is a perspective view of a new heated vibrating foot massaging device according to the present invention.
Figure 2:
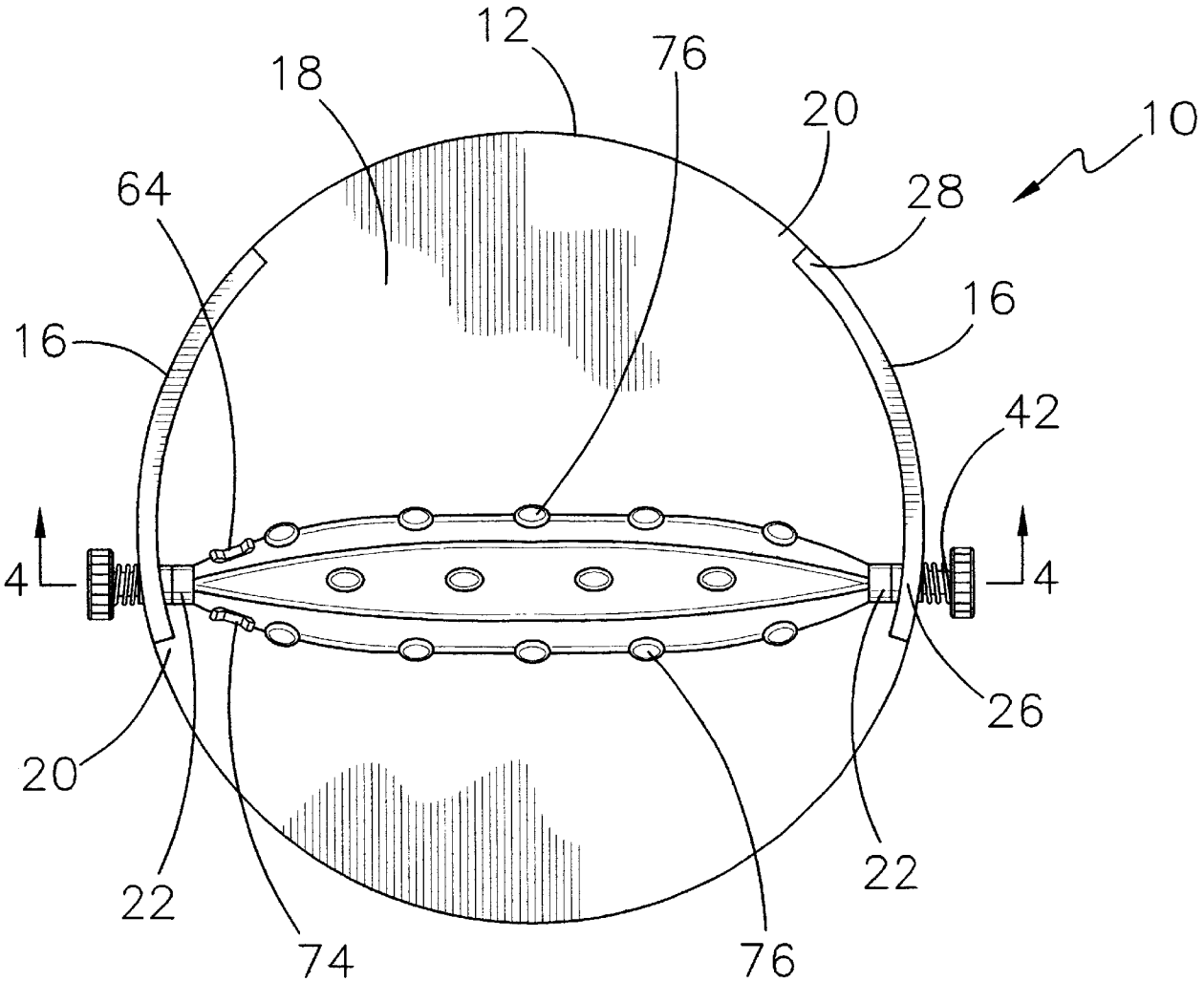
FIG. 2 is a top view of the present invention.
Figure 3:
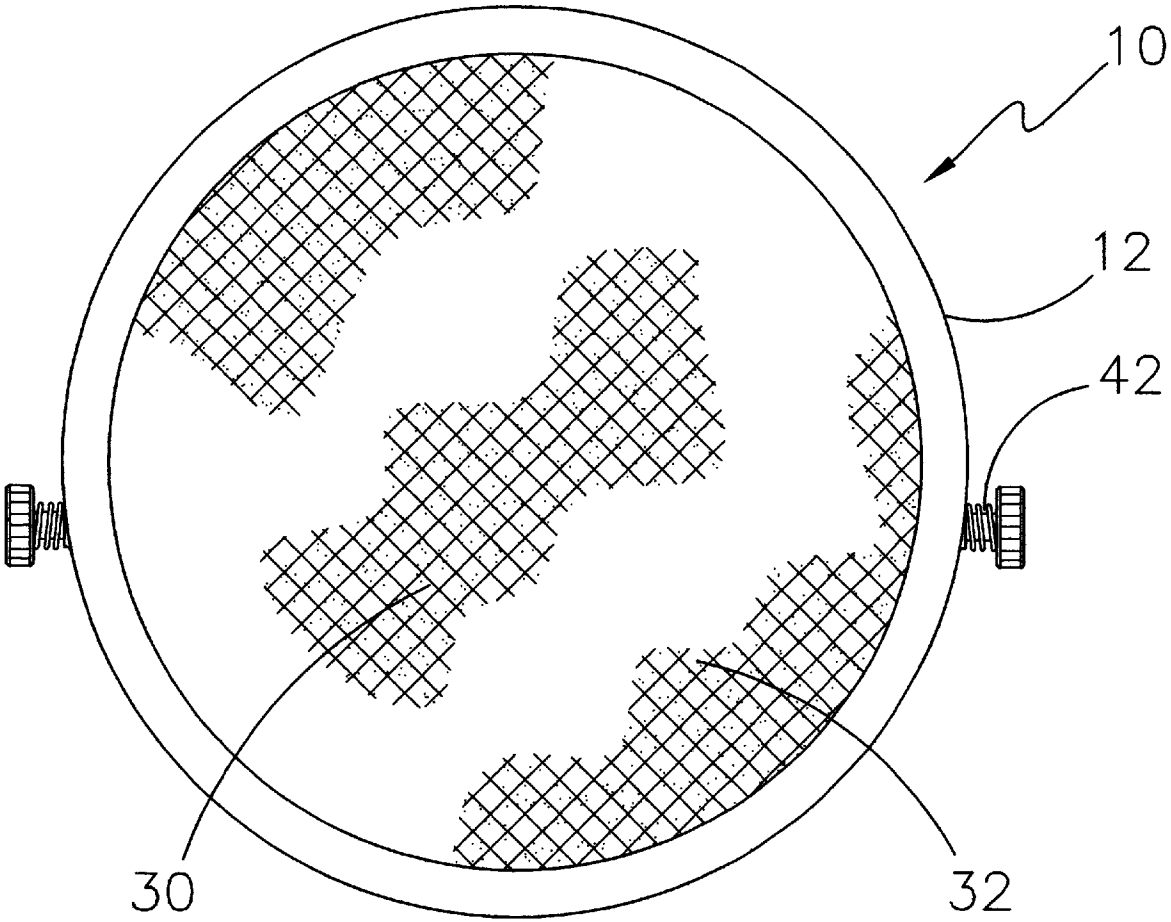
FIG. 3 is a bottom view of the present invention.
Figure 4:
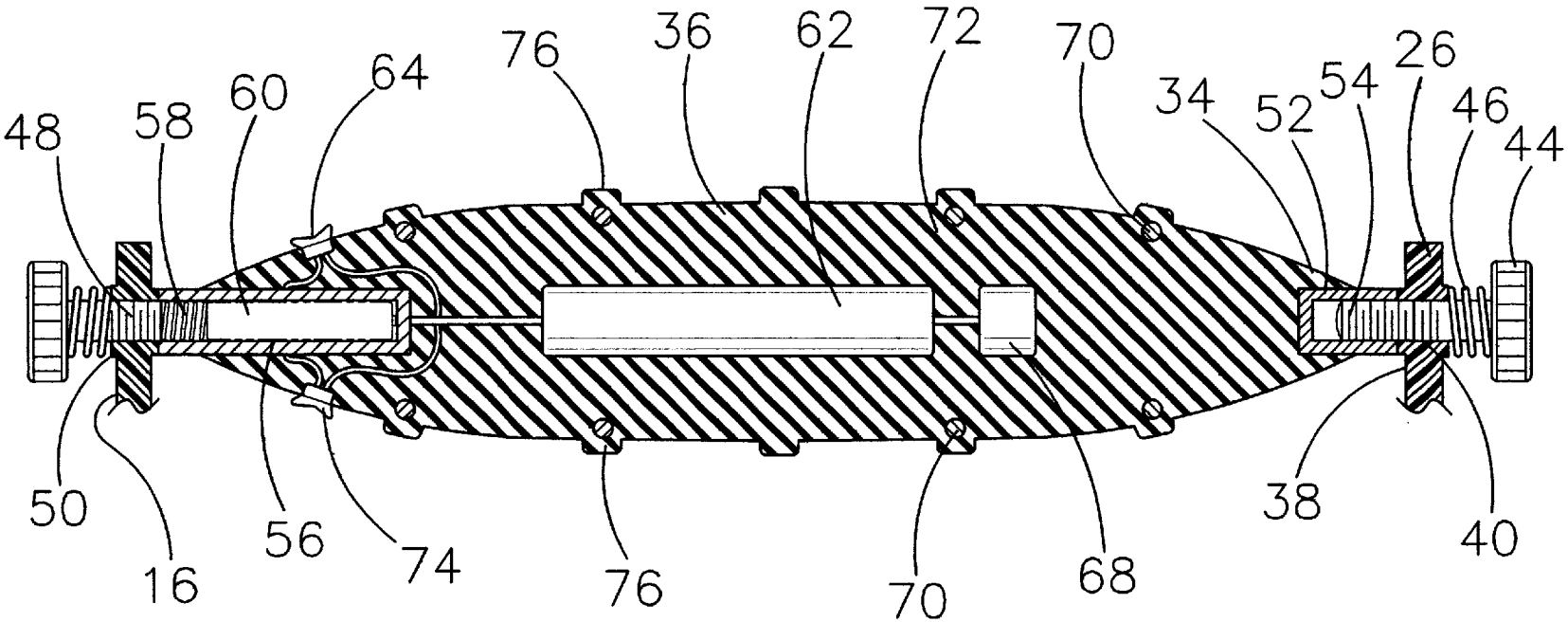
FIG. 4 is a cross-sectional view of the massage unit of the present invention.

With reference now to the drawings, and in particular to FIGS. 1 through 4 thereof, a new heated vibrating foot massaging device embodying the principles and concepts of the present invention and generally designated by the reference numeral 10 will be described.

As best illustrated in FIGS. 1 through 4, the heated vibrating foot massaging device 10 generally comprises a base member 12. The base member 12 comprises a substantially flat plate member 14 and a plurality of base wall members 16. The base wall members 16 are fixedly coupled to a top surface 18 of the flat plate member 14 symmetrically along a portion of a perimeter edge 20 of the flat plate member 14.

Distal ends 22 of a massage unit 24 are pivotally coupled to an uppermost portion 26 of the base wall members 16. The base member 12 is designed for supporting the massage unit 24 above a support surface for the purpose of permitting the user to utilize the massage unit 24 for reducing tension in the feet of the user.

The base wall members 16 are substantially perpendicular to the flat plate member 14. The base wall members 16 are substantially angled wherein a height of the uppermost portion 26 of the base wall members 16 are substantially greater than a height of a lowermost portion 28 of the base wall members 16. The base wall members 16 conform to an angle at which the feet of a user would be when contacting the massage unit 24.

A bottom surface 30 of the base member 12 comprises a substantially friction-enhancing material 32 thereby permitting the user to utilize the massage unit 24 without slippage of the base member 12.

The massage unit 24 is substantially semi-cylindrical. End portions 34 of the massage unit 24 are substantially smaller than a medial section 36 of the massage unit 24. The end portions 34 are designed for abutting an inside surface 38 of the base wall members 16.

The uppermost portion 26 of the base wall members 16 has a shaft hole 40. The shaft hole 40 is designed for receiving a plurality of tension assemblies 42.

The tension assemblies 42 comprise a tension knob 44 and a tension spring 46. The tension spring 46 receives a shaft portion 48 of the tension knob 44 wherein the shaft portion 48 of the tension knob 44 is insertable through the shaft hole 40 of the base wall members 16 from an outer surface 50 of the base wall members 16 into a bore 52 of the end portions 34 of the massage unit 24.

A threaded portion 54 of the shaft portion 48 is threadably couplable to the bore 52 of the end portions 34. Upon tightening of the tension knob 44, the tension spring 46 biases the tension knob 44 outwardly against the outer surface 50 of the base wall members 16 thereby creating frictional rotation adjustment of the massage unit 24.

One of the end portions 34 of the base wall members 16 has a cavity 56. The cavity 56 is an extension of the bore 52. The cavity 56 is designed for receiving a spring member 58 and a battery 60 such that the shaft portion 48 of the tension knob 44 abuts the spring member 58 thereby biasing the battery 60 inwardly until fully received in the cavity 56.

The massage unit 24 includes a vibrator member 62. The vibrator member 62 is centrally located along a longitudinal axis of the massage unit 24 such that the vibrator member 62 is designed for creating an oscillation of the massage unit 24 for the purpose of stimulating the feet of the user.

The massage unit 24 has a vibrator switch 64. The vibrator switch 64 is positioned on an exterior surface 66 of the massage unit 24 proximate the end portion having the battery 60. The vibrator switch 64 is operationally coupled to the battery 60 and the vibrator member 62 such that the vibrator switch 64 is designed for actuating the vibrator member 62.

The massage unit 24 includes a heater member 68. The heater member 68 is located in the massage unit 24. A plurality of heater elements 70 is integrally wound throughout a body portion 72 of the massage unit 24. The heater elements 70 are heated by the heater member 68 when the heater member 68 is activated thereby warming the exterior surface 66 of the massage unit 24 for the purpose of soothing the feet of the user.

The massage unit 24 has a heater switch 74. The heater switch 74 is positioned on the exterior surface 66 of the massage unit 24 proximate the end portion that has the battery 60. The heater switch 74 is operationally coupled to the battery 60 and the heater member 68 such that the heater switch 74 is designed for actuating the heater member 68.

The massage unit 24 has a plurality of pressure point members 76. The pressure point members 76 have a substantially bulbous shape. The pressure point members 76 are numerously located on an exterior surface 66 of the massage unit 24 such that the pressure point members 76 are designed for stimulating the feet of the user for the purpose of relaxation and foot ecstasy.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A heated vibrating foot massaging device for reducing tension in the feet of a user, the heated vibrating foot massaging device comprising:

a base member, said base member comprising a substantially flat plate member and a plurality of base wall members, said base wall members being fixedly coupled to a top surface of said flat plate member symmetrically along a portion of a perimeter edge of said flat plate member;

a massage unit, distal ends of said massage unit being rotatably coupled to an uppermost portion of said base wall members such that said base member being adapted for supporting said massage unit above a support surface for the purpose of permitting the user to utilize said massage unit for reducing tension in the feet of the user;

said massage unit including a heater member;

said massage unit including a vibrator member;

end portions of said massage unit being substantially smaller than a medial section of said massage unit;

said uppermost portion of said base wall members having a shaft hole;

said tension assemblies comprising a tension knob and a tension spring, said tension spring receiving a shaft portion of said tension knob wherein said shaft portion of said tension knob being insertable through said shaft hole of said base wall members from an outer surface of said base wall members into a bore of said end portions of said massage unit;

a threaded portion of said shaft portion being threadably couplable to said bore of said end portions such that upon tightening of said tension knob said tension spring biases said tension knob outwardly against said outer surface of said base wall members thereby creating frictional rotation adjustment of said massage unit;

said base wall members having end portions, one of said end portions of said base wall members having a cavity, said cavity being an extension of said bore; and said cavity receiving a spring member and a battery such that said shaft portion of said tension knob abuts said spring member thereby biasing said battery inwardly until fully received in said cavity.

2. The heated vibrating foot massaging device as set forth in claim 1, further comprising:

said base wall members being substantially perpendicular to said flat plate member, said base wall members being substantially angled wherein a height of said uppermost portion of said base wall members being substantially greater than a height of a lowermost portion of said base wall members such that said base wall members conforming to an angle at which the feet of a user would be when contacting said massage unit.

3. The heated vibrating foot massaging device as set forth in claim 1, further comprising:

a bottom surface of said base member comprising a substantially friction-enhancing material thereby permitting the user to utilize said massage unit without slippage of said base member.

4. The heated vibrating foot massaging device as set forth in claim 1, further comprising:

said vibrator member being centrally located along a longitudinal axis of said massage unit such that said vibrator member being adapted for creating an oscillation of said massage unit for the purpose of stimulating the feet of the user.

5. The heated vibrating foot massaging device as set forth in claim 4, further comprising:

said massage unit having a vibrator switch, said vibrator switch being positioned within an exterior surface of said massage unit proximate said end portion having said battery, said vibrator switch being operationally coupled to said battery and said vibrator member such that said vibrator switch being adapted for actuating said vibrator member.

6. The heated vibrating foot massaging device as set forth in claim 1, further comprising:

said heater member being located in said massage unit, a plurality of heater elements being integrally wound throughout a body portion of said massage unit such that said heater elements being heated by said heater member when said heater member being activated thereby warming an exterior surface of said massage unit for the purpose of soothing the feet of the user.

7. The heated vibrating foot massaging device as set forth in claim 6, further comprising:

said massage unit having a heater switch, said heater switch being positioned within an exterior surface of said massage unit proximate said end portion having said battery, said heater switch being operationally coupled to said battery and said heater member such that said heater switch being adapted for actuating said heater member.

8. The heated vibrating foot massaging device as set forth in claim 1, further comprising:

said massage unit having a plurality of pressure point members, said pressure point members having a substantially bulbous shape, said pressure point members being numerously located on an exterior surface of said massage unit such that said pressure point members being adapted for stimulating the feet of the user for the purpose of relaxation and foot ecstasy.

9. A heated vibrating foot massaging device for reducing tension in the feet of a user, the heated vibrating foot massaging device comprising:

a base member, said base member comprising a substantially flat plate member and a plurality of base wall members, said base wall members being fixedly coupled to a top surface of said flat plate member symmetrically along a portion of a perimeter edge of said flat plate member;

a massage unit, distal ends of said massage unit being rotatably coupled to an uppermost portion of said base wall members such that said base member being adapted for supporting said massage unit above a support surface for the purpose of permitting the user to utilize said massage unit for reducing tension in the feet of the user;

said base wall members being substantially perpendicular to said flat plate member, said base wall members being substantially angled wherein a height of said uppermost portion of said base wall members being substantially greater than a height of a lowermost portion of said base wall members such that said base wall members conforming to an angle at which the feet of a user would be when contacting said massage unit;

a bottom surface of said base member comprising a substantially friction-enhancing material thereby permitting the user to utilize said massage unit without slippage of said base member;

end portions of said massage unit being substantially smaller than a medial section of said massage unit;

said uppermost portion of said base wall members having a shaft hole;

said tension assemblies comprising a tension knob and a tension spring, said tension spring receiving a shaft portion of said tension knob wherein said shaft portion of said tension knob being insertable through said shaft hole of said base wall members from an outer surface of said base wall members into a bore of said end portions of said massage unit;

a threaded portion of said shaft portion being threadably couplable to said bore of said end portions such that upon tightening of said tension knob said tension spring biases said tension knob outwardly against said outer surface of said base wall members thereby creating frictional rotation adjustment of said massage unit;

one of said end portions of said base wall members having a cavity, said cavity being an extension of said bore;

said cavity receiving a spring member and a battery such that said shaft portion of said tension knob abuts said spring member thereby biasing said battery inwardly until fully received in said cavity;

said massage unit including a vibrator member, said vibrator member being centrally located along a longitudinal axis of said massage unit such that said vibrator member being adapted for creating an oscillation of said massage unit for the purpose of stimulating the feet of the user;

said massage unit having a vibrator switch, said vibrator switch being positioned within an exterior surface of said massage unit proximate said end portion having said battery, said vibrator switch being operationally coupled to said battery and said vibrator member such that said vibrator switch being adapted for actuating said vibrator member;

said massage unit including a heater member, said heater member being located in said massage unit, a plurality of heater elements being integrally wound throughout a body portion of said massage unit such that said heater elements being heated by said heater member when said heater member being activated thereby warming an exterior surface of said massage unit for the purpose of soothing the feet of the user;

said massage unit having a heater switch, said heater switch being positioned within an exterior surface of said massage unit proximate said end portion having said battery, said heater switch being operationally coupled to said battery and said heater member such that said heater switch being adapted for actuating said heater member;

said massage unit having a plurality of pressure point members, said pressure point members having a substantially bulbous shape, said pressure point members being numerously located on an exterior surface of said massage unit such that said pressure point members being adapted for stimulating the feet of the user for the purpose of relaxation and foot ecstasy.

* * * * *